US010077543B2

(12) United States Patent
Heinzmann et al.

(10) Patent No.: US 10,077,543 B2
(45) Date of Patent: Sep. 18, 2018

(54) QUICK DISCONNECT JOYSTICK SYSTEM AND METHOD

(71) Applicant: Caterpillar Inc., Peoria, IL (US)

(72) Inventors: Mitchell Heinzmann, Durham, NC (US); Matt Harrenstein, Fuquay-Varina, NC (US); Mitchell Otis, Indian Trail, NC (US); Joel Willis, Garner, NC (US); Gabriella Mirabelli, Raleigh, NC (US); Kristin Heckart, Raleigh, NC (US)

(73) Assignee: Caterpillar Inc., Deerfield, IL (US)

( * ) Notice: Subject to any disclaimer, the term of this patent is extended or adjusted under 35 U.S.C. 154(b) by 256 days.

(21) Appl. No.: 15/200,644

(22) Filed: Jul. 1, 2016

(65) Prior Publication Data

US 2018/0002893 A1 Jan. 4, 2018

(51) Int. Cl.

| | |
|---|---|
| ***E02F 9/20*** | (2006.01) |
| ***G05G 9/047*** | (2006.01) |
| ***E02F 3/96*** | (2006.01) |
| *E02F 3/34* | (2006.01) |

(52) U.S. Cl.

CPC ..... *E02F 9/2004* (2013.01); *E02F 3/96* (2013.01); *G05G 9/047* (2013.01); *E02F 3/3414* (2013.01); *G05G 2009/04774* (2013.01)

(58) Field of Classification Search

CPC ..... E02F 9/2004; E02F 3/96; E02F 3/3414; G05G 9/047; G05G 2009/04774

See application file for complete search history.

(56) References Cited

U.S. PATENT DOCUMENTS

| | | | | |
|---|---|---|---|---|
| 7,757,579 | B2 | 7/2010 | Bloch | |
| 7,758,424 | B2 * | 7/2010 | Riggs | A63F 13/06 341/20 |
| 8,264,458 | B2 | 9/2012 | Cooper et al. | |
| 9,764,230 | B2 * | 9/2017 | Gassoway | A63F 13/24 |
| 9,925,457 | B2 * | 3/2018 | Gassoway | A63F 13/24 |
| 2006/0007144 | A1 | 1/2006 | Mathiasen et al. | |
| 2006/0125790 | A1 * | 6/2006 | Edmunds | G05G 9/047 345/161 |
| 2009/0201250 | A1 * | 8/2009 | Vazquez | G05G 9/047 345/161 |
| 2009/0225028 | A1 | 9/2009 | Abrams et al. | |
| 2009/0232585 | A1 * | 9/2009 | Gilbreath | F16L 37/088 403/14 |
| 2012/0065847 | A1 * | 3/2012 | Hobenshield | E02F 9/2004 701/50 |

(Continued)

*Primary Examiner* — Darlene P Condra

(74) *Attorney, Agent, or Firm* — Leydig, Voit & Mayer, Ltd.

(57) ABSTRACT

Systems and methods of adapting a work machine to operate a plurality of interchangeable work tools. Systems according to the disclosure employ interchangeable joystick controllers, each having different configurations optimized to the operator and/or the particular operating parameters and/or requirements of the selected work tool. Each of the joysticks has a standardized mechanical and/or electrical connection for attachment to the work machine via a standardized base. The base receives control communications from the selected/paired joystick and is configured to adapt the control communications to a standardized signal format such that the work machine operates the work tool according to inputs from the selected joystick.

20 Claims, 8 Drawing Sheets

(56) References Cited

U.S. PATENT DOCUMENTS

| | | | | |
|---|---|---|---|---|
| 2014/0253446 | A1* | 9/2014 | Petersen | G06F 3/0338 345/161 |
| 2015/0191890 | A1 | 7/2015 | Ryan | |
| 2017/0031382 | A1* | 2/2017 | Niguet | G05G 9/047 |
| 2017/0114524 | A1* | 4/2017 | Wuisan | E02F 3/765 |
| 2017/0123414 | A1* | 5/2017 | Gray | G05D 1/0016 |

* cited by examiner

QUICK DISCONNECT JOYSTICK SYSTEM AND METHOD

TECHNICAL FIELD

This disclosure relates to operator interfaces and a system and method of controlling work machines, and more particularly, to modular joysticks.

BACKGROUND

Work machines can be used in many different applications, including those in the areas of construction, agriculture, landscaping, and mining. To perform these applications, a work tool is typically mounted to work machine lift arms or other articulated members of the work machine and connect to one or more hydraulic and/or electrical and/or mechanical system of the work machine.

Many work machines are designed to receive and operate a vast number of work tools. One such work machine is known generically as a "skidsteer." A skidsteer, skid loader, or skidsteer loader, is a small, rigid-frame, engine-powered machine with lift arms and a mounting interface used to receive and attach to a wide variety of labor-saving tools or attachments. Examples of work tools for a skidsteer include augers, backhoes, bale spears, blades, brooms, brush cutters, buckets, cold planers, compactors, forks, hammers, material handling arms, mulchers, rakes, saws, snow blowers, snowplows, snow pushers, stump grinders, tillers, and trenchers.

Skidsteer loaders are typically four-wheel vehicles with the wheels mechanically locked in synchronization on each side. The left-side drive wheels can be driven independently of the right-side drive wheels. The wheels typically have no separate steering mechanism and hold a fixed straight alignment on the body of the machine. By operating the left and right wheel pairs at different speeds, the machine turns by skidding, or dragging its fixed-orientation wheels across the ground. Skidsteer loaders are sometimes equipped with tracks in lieu of the wheels and such a vehicle is known as a multi-terrain loader.

In order to maximize the value of machine ownership, it is desirable that work machine equipment be compatible with a large variety of work tools and adaptable to a large variety of operator preferences. Since the control requirements of a selected work tool is dependent on its function, one standard configuration is poorly suited for optimal operator control of all possible work tool attachments.

Currently, a small number of operator interfaces, one type of which will be referred to herein as "joysticks," fitted to the work machine at the time of manufacture have to accommodate a range of alternative work tools and operators. Complicated harness adapters are necessary to retrofit current joysticks, which compromise adaptation of the work machine to different work tools. It is also labor intensive and expensive to swap control bases and joysticks on a completed machine.

SUMMARY

In one aspect, the present disclosure describes a system for controlling a work machine including a machine controller. The work machine includes a first joystick having a first plurality of control input devices arranged in a first configuration. The first plurality of control input devices is adapted to operate a first work tool of the work machine. The first joystick includes a handle body, a first electronic controller positioned in the handle body and operably associated with the first plurality of control input devices, a first electronic communication system, and a first mechanical connection. A second joystick has a second plurality of control input devices arranged in a second configuration. The second plurality of control input devices is adapted to operate a second work tool of the work machine. The second joystick includes a handle body, a second electronic controller positioned in the handle body and operably associated with the second plurality of control input devices, a second electronic communication system, and a second mechanical connection. A base is associated with the work machine. The base includes a mechanical connection and is associated with a base electronic controller. The base electronic controller is configured, in a first arrangement paired with the first joystick, to communicate with the first electronic controller via the first electronic communication system and transmit to the machine controller communications relative to control signals from the first electronic controller operating the first work tool with the mechanical connection releasably engaged to the first mechanical connection. The base electronic controller is configured, in a second arrangement paired with the second joystick, to communicate with the second electronic controller via the second electronic communication system and transmit to the machine controller communications relative to control signals from the second electronic controller operating the second work tool with the mechanical connection releasably engaged to the second mechanical connection.

In another aspect, a method of operating a work machine is provided including a machine controller, a first joystick having a first plurality of control input devices arranged in a first configuration. The first plurality of control input devices are adapted to operate a first work tool of the work machine. The first joystick includes a handle body, a first electronic controller positioned in the handle body and operably associated with the first plurality of control input devices, a first electronic communication system, a first mechanical connection and a first electrical connection. A second joystick has a second plurality of control input devices arranged in a second configuration. The second plurality of control input devices are adapted to operate a second work tool of the work machine. The second joystick includes a handle body, a second electronic controller positioned in the handle body and operably associated with the second plurality of control input devices, a second electronic communication system, a second mechanical connection and a second electrical connection. A base is associated with the work machine and includes a mechanical connection, a electrical connection, and a base electronic controller in operative communication with the machine controller. The method includes engaging the mechanical connection on the base with the first mechanical connection on the first joystick. The electrical connection on the base and the first electrical connection are connected to permit electrical transmission of communications relative to control signals to be carried out between the first electronic controller and the base electronic controller. The first work tool is operated with the first joystick. The first work tool is replaced with the second work tool. The first joystick is replaced with the second joystick by disengaging the first joystick from the base and engaging the mechanical connection on the base with the second mechanical connection on the second joystick, connecting the electrical connection on the base and the second electrical connection to permit electrical transmission of the communications relative to the control signals to be carried out between the second electronic controller and the base electronic controller. The second work tool is operated with the second joystick.

The disclosure also provides a work machine, including a first work tool and a second work tool, which are mountable to the work machine. Each of the first work tool and the second work tool has a set of operating parameters associated therewith. At least one of a mechanical system, an electromechanical system, and a hydraulic system is positioned on the work machine to operate a mounted one of the first work tool and the second work tool. A machine controller is configured to control the operation of the at least one of the mechanical system, the electromechanical system, and the hydraulic system. A first joystick has a first plurality of control input devices arranged in a first configuration adapted to operate the first work tool, the first joystick comprising a handle body, a first electronic controller positioned in the handle body and operably associated with the first plurality of control input devices, a first electronic communication system, and a first mechanical connection. A second joystick has a second plurality of control input devices arranged in a second configuration adapted to operate the second work tool, the second joystick comprising a handle body, a second electronic controller positioned in the handle body and operably associated with the second plurality of control input devices, a second electronic communication system, and a second mechanical connection. A base is associated with the work machine. The base includes a mechanical connection and being associated with a base electronic controller. The base electronic controller is configured in a first arrangement paired with the first joystick, to communicate with the first electronic controller via the first electronic communication system and transmit to the machine controller communications relative to control signals from the first electronic controller operating the first work tool with the mechanical connection releasably engaged to the first mechanical connection. The base electronic controller is configured, in a second arrangement paired with the second joystick, to communicate with the second electronic controller via the second electronic communication system and transmit to the machine controller communications relative to control signals from the second electronic controller operating the second work tool with the mechanical connection releasably engaged to the second mechanical connection.

Further and alternative aspects and features of the disclosed principles will be appreciated from the following detailed description and the accompanying drawings. As will be appreciated, the principles related to determining wear of artificial joints as disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
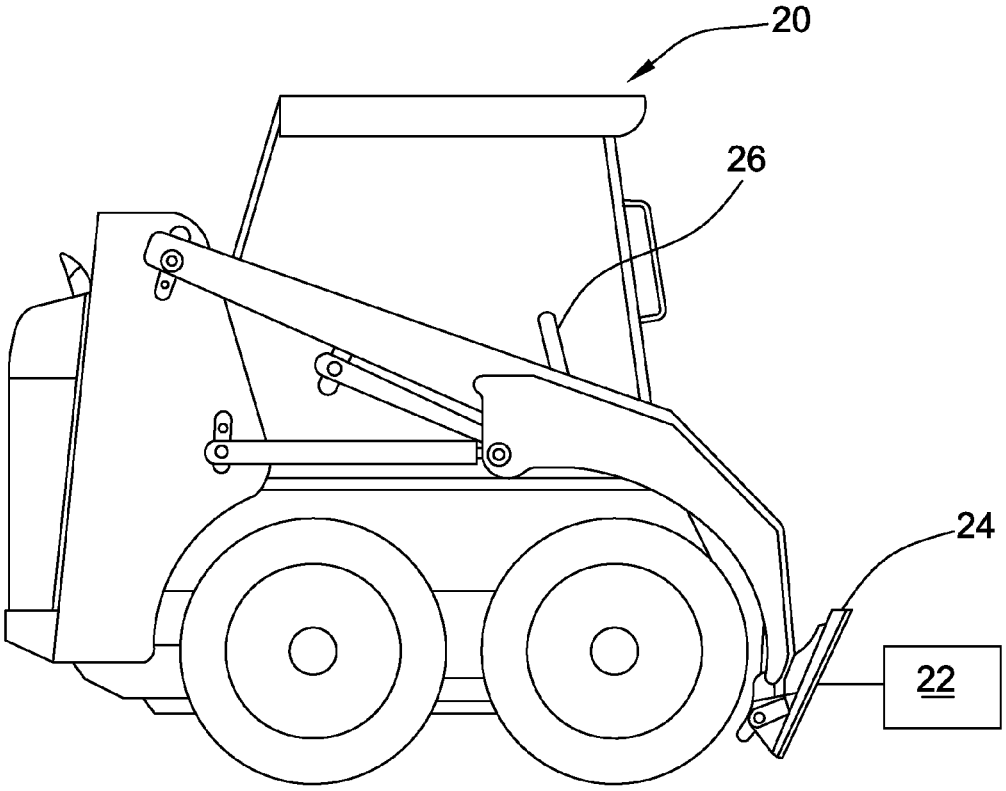
FIG. 1 is a side view of an embodiment of a work machine.

FIG. 1 illustrates a type of work machine 20 known as a skidsteer loader according to an exemplary embodiment of the present disclosure. Although FIG. 1 depicts a skidsteer loader, it will be understood that the present disclosure may be used in conjunction with other work machines known in the art. Such work machines may include, but are not limited to, wheel dozers, wheel loaders, track loaders, backhoe loaders, compactors, forest machines, front shovels, hydraulic excavators, integrated tool carriers, multi-terrain loaders, material handlers, and agricultural tractors.

As illustrated in FIG. 1, a work tool or work implement 22 may be operatively attached to the front end of the work machine 20. It will be understood that if a work machine 20 is capable of utilizing rear-mounted work tools, such tools may also be operatively attached to the back-end of the work machine 20. The work machine 20 is provided with a work tool receiver 24 that is configured to accept a variety of work tools 22.

In general, work tools 22 may be divided into two categories: those capable of performing a single application and those capable of performing more than one. Such so-called "single-application" work tools 22 may include, but are not limited to, trenching tools, material handling arms, augers, brooms, rakes, stump grinders, snow blowers, wheel saws, de-limbers, tire loaders, and asphalt cutters. Likewise, "multi-application" tools, may include, but are not limited to buckets, angle blades, cold planers, compactors, forks, landscape rakes, grapples, backhoes, hoppers, multi-processors, truss booms, and thumbs. The present disclosure contemplates a system that is adaptable to any type of work tool 22.

In the illustrated exemplary embodiment, the work tool 22 attached to the work machine 20 may be either a single-application or a multi-application work tool 22. Moreover, the applications capable of being performed by the work tool 22 may include, but are not limited to, stockpiling, trenching, hammering, digging, raking, grading, moving pallets, material handling, snow removal, tilling soil, demolition work, carrying, cutting, backfilling, and sweeping. Work machines 20 that have more flexibility regarding attachment and use of a great number and variety of work tools are especially enhanced by the systems and methods of the present disclosure.

A user input device 26 is used to control operation of the work machine 20 to generate directional inputs to cause the machine to move forward and reverse, and to cause the machine to turn right and left. The user input device 26 may be in the form of a joystick.

The user input device 26 also operates a selected work tool 22. Some embodiments of the disclosure may include two separate user input devices 26, one provided for each hand of the operator. If two joysticks are employed, the functions of each may be distributed between the two joysticks according to any suitable arrangement. In one example, one joystick 26 may be configured to operate the basic functions of the work machine, such as locomotion of the machine itself, such as control of forward, backward and turning operations, and the other joystick may be configured to operate the various functions of the work tool 22. The user input device 26 that operates the work tool may include two or more interchangeable joysticks, each configured to operate a different work tool. Alternatively, different configurations of joysticks may provide different features, which include but are not limited to, heated grips for cold weather operation, alternative sizes and/or shapes, left and right hand configurations, and/or other configurations or features.

Figure 2:
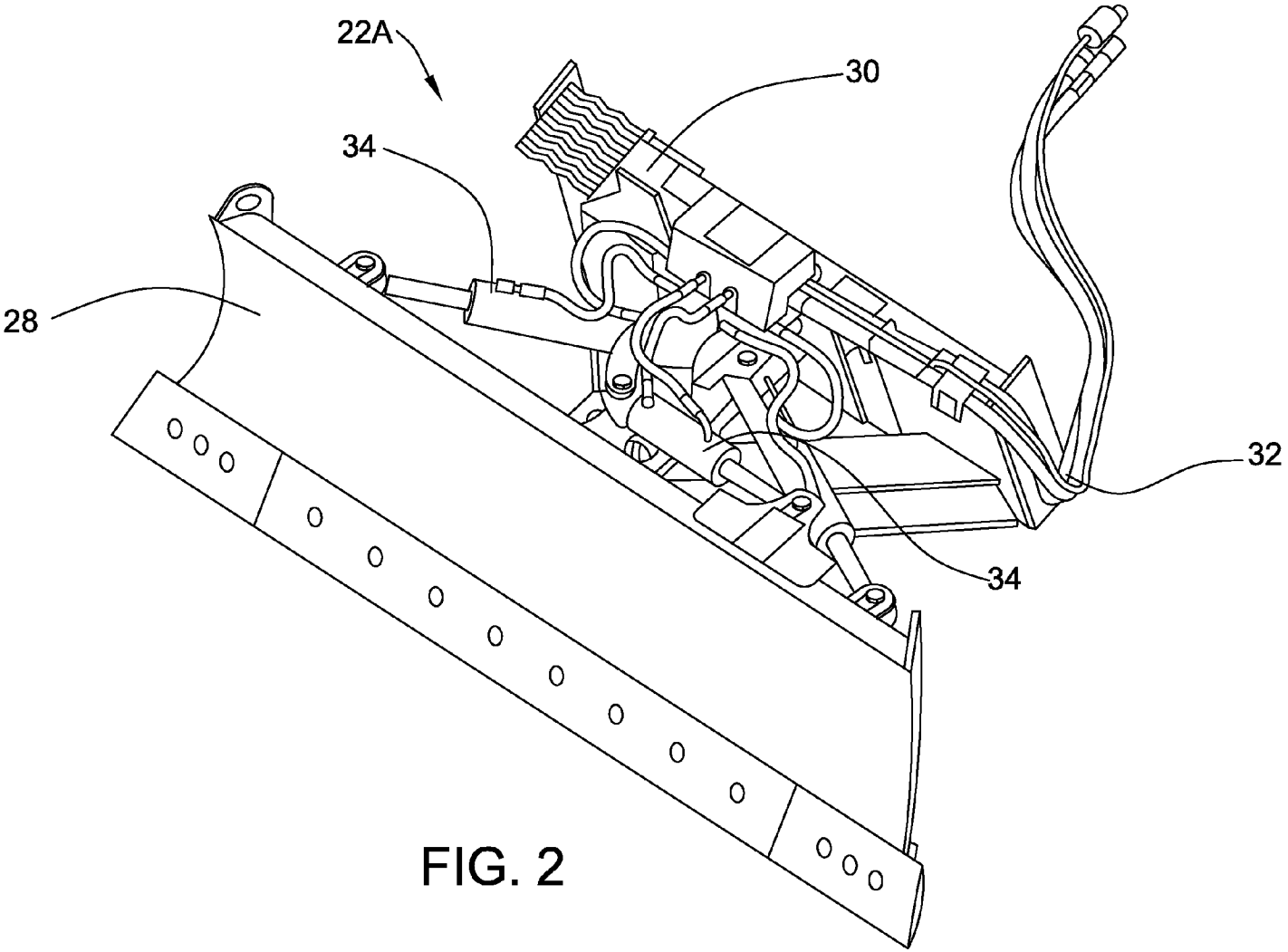
FIG. 2 is a first work tool for use in operation of the work machine of FIG. 1.

One example of a first work tool 22A is shown in FIG. 2. The illustrated work tool 22A includes a blade 28. The first work tool 22A includes a frame 30 that supports the blade 28 and attaches to the receiver 24 of the work machine 20. The first work tool 22A may have hydraulic, electrical and mechanical systems 32 attachable to the work machine 20 to provide the work machine with the ability to communicate with and operate the work tool 22A. For example, the first work tool 22A includes hydraulic cylinders 34 that angle the blade 28 up and down relative to the frame 30, angle the blade horizontally left and right relative to the frame, and change the elevation of one end of the blade relative to the other end of the blade.

Figure 4:
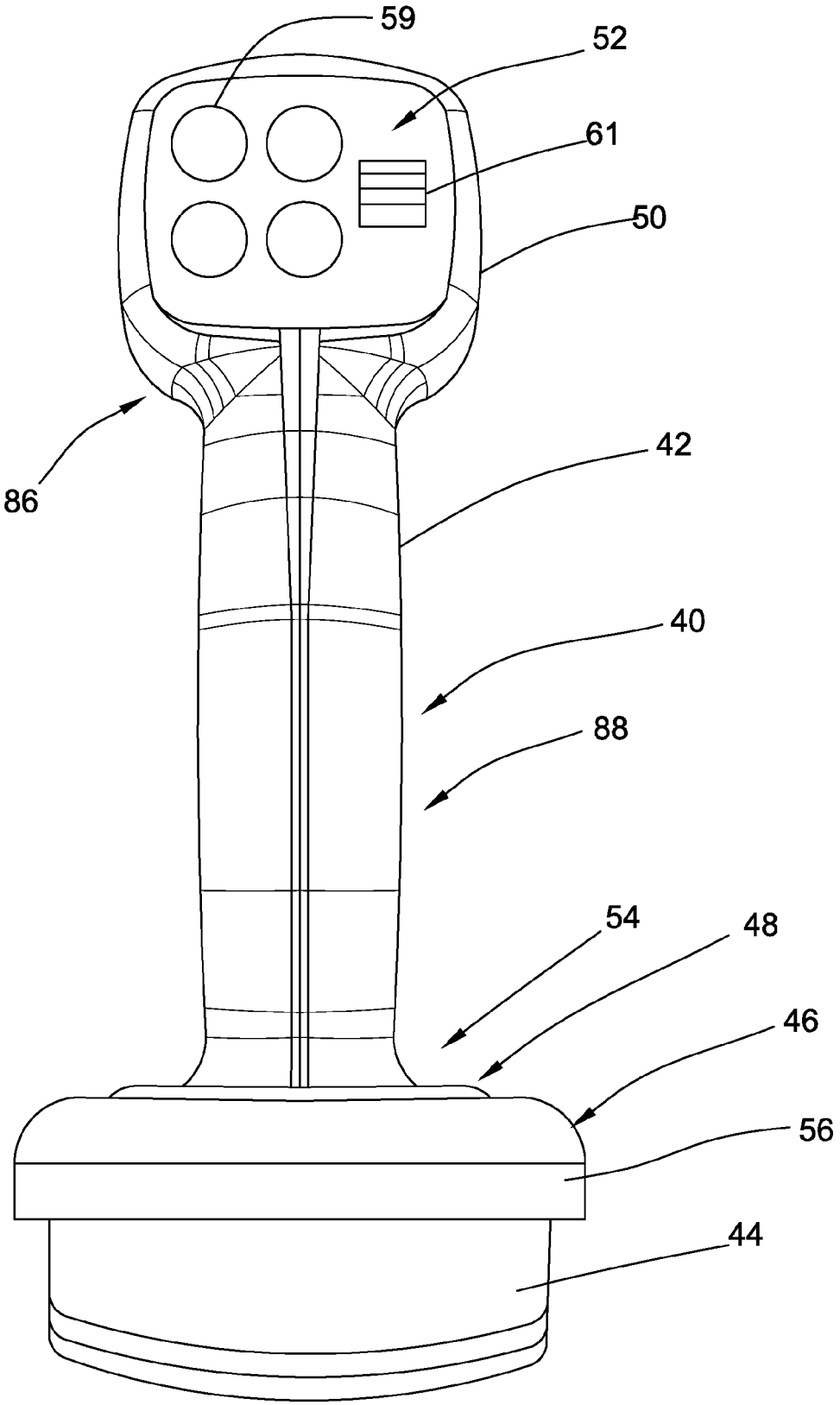
FIG. 4 is a quick connect joystick according to a first embodiment and having a first configuration corresponding to use with the work tool of FIG. 2.

Turning to FIG. 4, a first joystick 40 configured as illustrated can be used to operate the first work tool 22A (FIG. 2). The first joystick 40 includes a handle body 42. The handle body 42 may be two or more pieces or a single body construction. The first joystick 40 includes a distally located control end 50 with a first plurality of control input devices 52. The first plurality of control input devices 52 can include a plurality of a single type of control input device, such as buttons, switches, linear sliders, toggles, dials, rotary knobs, thumbwheels, triggers, or other manually operated actuators, or any suitable combination of different types of control input devices. The first plurality of control input devices 52 are in communication with a first electronic controller 86 via wires and/or circuitry. A first electronic communication system 88 connects the first electronic controller 86 to the work machine 20 as will be explained in more detail below.

The handle body 42 includes an attachment end 54 opposite the control end 50. The attachment end 54 is releasably attachable to a base 44. The base 44 is integral to the work machine 20 (FIG. 1). The attachment end 54 is releasably attached to the base 44 by way of a mechanical connection 46 provided on the base 44 and a first mechanical connection 48 provided on the first joystick 40, the details of which will be set out hereinbelow. A threaded nut 56 couples to the base and retains the joystick 40 in place to secure the joystick 40 attachment to the base 44. The joystick 40 may be attached to the base 44 without the use of tools and the threaded nut 56 may be installed by hand in a tool-less fashion to secure the parts together. Any other suitable form of securing may be used to attach the joystick 40 to the base 44.

In the illustrated example, four-button style input devices 59 and one continuously variable wheel input device 61 are arranged on the control end 50 of the first joystick 40. The four-button style input devices 59 are arranged in an array resembling a square, although any suitable arrangement is contemplated. The upper-most pair of input devices 59 may change the left and right angular orientation of the blade 28 (FIG. 2). The lower-most pair of input devices 59 may change the blade 28 from a horizontal orientation to one where either the right edge or left edge is lower than the other edge. The wheel input device 61 may be used to vary the angle of the blade 28 to the ground, relatively face up or down. Finally, the entire handle body 42 may be used to raise and lower the entire work tool 22A (FIG. 2) by raising and lowering the receiver 24 (FIG. 1). It will be understood that other types of input devices may be substituted for those illustrated, provided they are suitable for the control task required by the work tool 22A.

Figure 3:
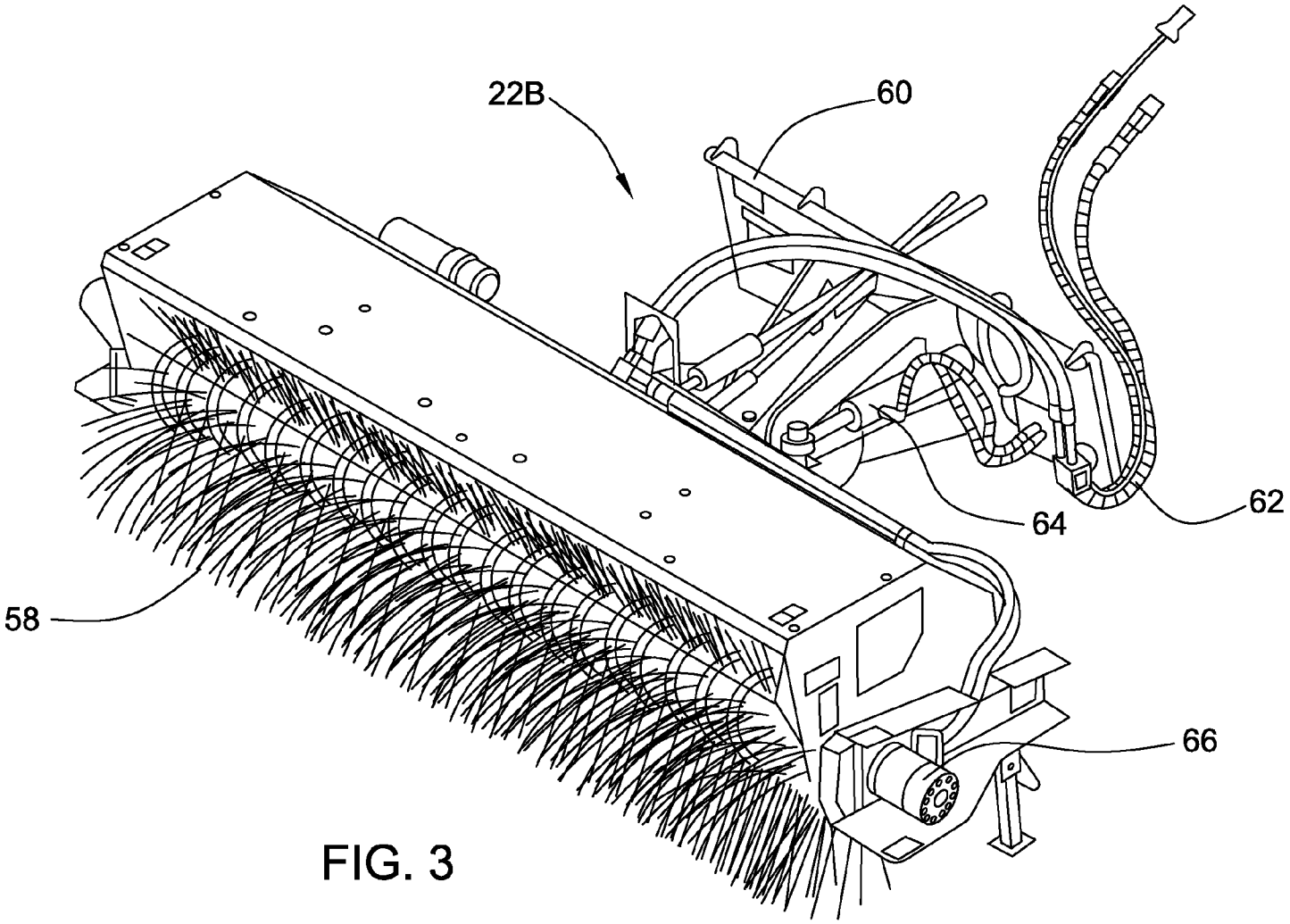
FIG. 3 is a second work tool for use in operation of the work machine of FIG. 1.

FIG. 3 shows a second work tool 22B. The illustrated work tool 22B includes a rotatable, cylindrical brush 58. The second work tool 22B includes a frame 60 that supports the brush 58 and attaches to the receiver 24 of the work machine 20. The second work tool 22B may have hydraulic, electrical and mechanical systems 62 attachable to the work machine 20 to provide the work machine with the ability to communicate with and operate the work tool 22B. For example, the second work tool 22B includes hydraulic cylinders 64 that angle the brush 58 horizontally left and right relative to the frame 60. The second work tool 22B also includes a motor 66 that operatively rotates the brush 58.

Figure 5:
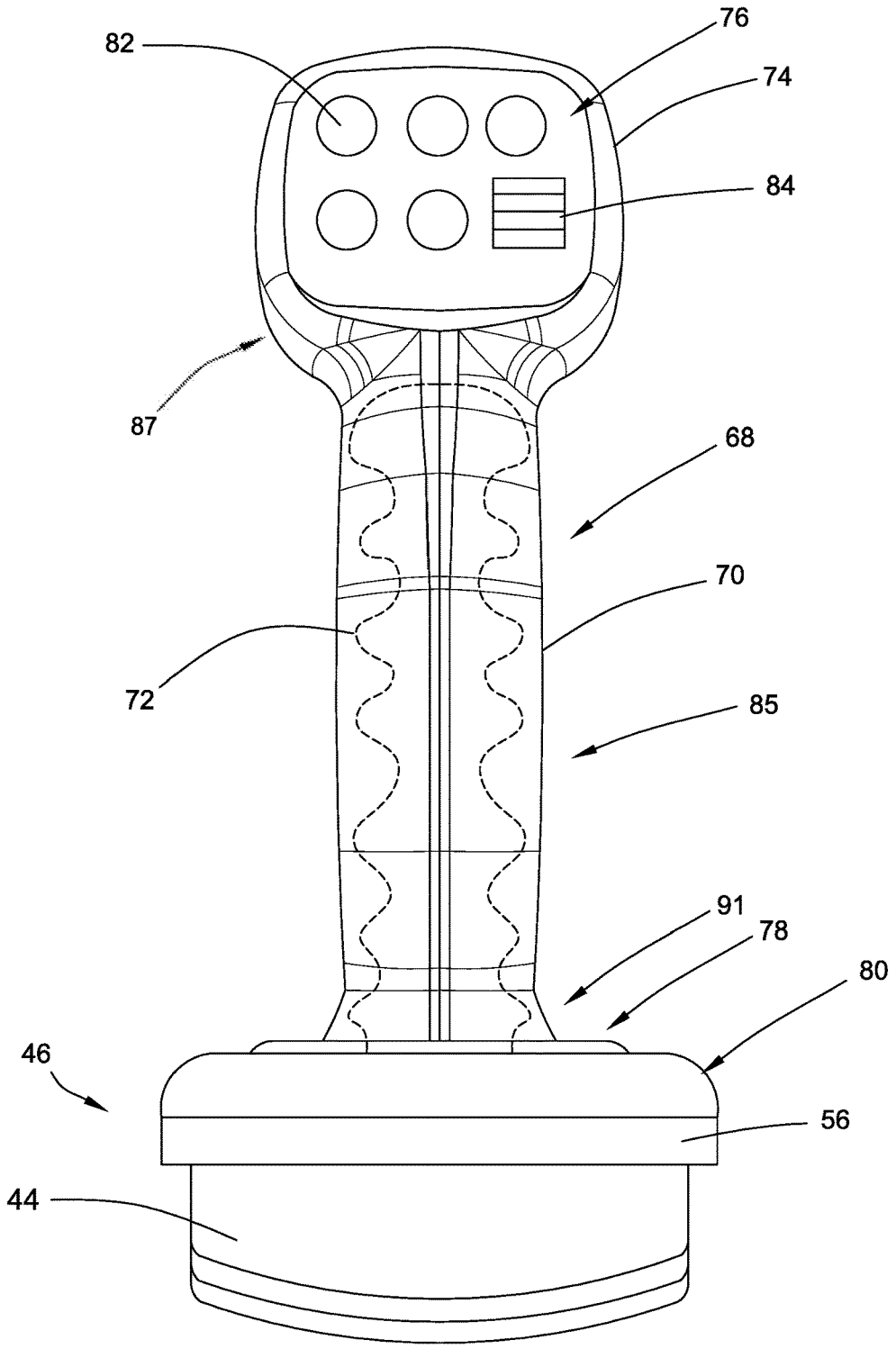
FIG. 5 is a quick connect joystick according to a second embodiment and having a second configuration corresponding to use with work tool of FIG. 3.

FIG. 5 shows a second joystick 68, which configured as illustrated can be used to operate the second work tool 22B (FIG. 3). The second joystick 68 includes a handle body 70. The handle body 70 may be two or more pieces or a single body construction. The handle body 70 may be the same in shape in size as the handle body 42 of the first joystick 40 or different ergonomically or different in features. For example, the handle body 42 of the first joystick 40 may be configured for right hands and the handle body 70 of the second joystick 68 may be configured for left hands. Other alternative configurations are contemplated. For example, the handle body 42 of the first joystick 40 may be without a heating element and the handle body 70 of the second joystick 68 may be configured with a heating element 72, such as a resistive heating element.

The second joystick 68 includes a distally located control end 74 with a second plurality of control input devices 76. The second plurality of control input devices 76 can be different than the first plurality of control devices 52 of the first joystick 40 in type and/or configuration. The second plurality of control input devices 76 can include a plurality of a single type of control input device, such as buttons, switches, linear sliders, toggles, dials, rotary knobs, thumbwheels, triggers, or other manually operated actuators, or any suitable combination of different types of control input devices. The second plurality of control input devices 76 are in communication with a second electronic controller 87 via wires and/or circuitry. A second electronic communication system 85 connects the second electronic controller 87 to the work machine 20 as will be explained in more detail below.

The handle body 70 includes an attachment end 78 opposite the control end 74. The attachment end 78 is releasably attachable to the base 44. The attachment end 78 is releasably attached to the base 44 through the mechanical connection 46 provided on the base 44 and a second mechanical connection 80 provided on the second joystick 68. The first mechanical connection 48 and the second mechanical connection 80 are the same so as to be interchangeably compatible with the mechanical connection 46 of the base 44.

A threaded nut 56 couples to the base 44 and retains the second joystick 68 in place. The joystick 68 may be attached to the base 44 without the use of tools and the threaded nut 56 may be installed by hand in a tool-less fashion to secure the parts together.

In the illustrated example, five button or dial style input devices 82 and one continuously variable wheel input device 84 are arranged on the control end 74 of the second joystick 68. The button style input devices 82 and wheel input device 84 are collectively arranged in an array resembling a rectangle, although any suitable arrangement is contemplated. The upper-most trio of input devices 82 may change the left and right angular orientation of the brush 58 (FIG. 3). For example, the left one of the trio of upper input devices 82 may be a preset left angle setting, the center one of the upper input devices may be a preset centered setting, and the right one of the trio of upper input devices may be a preset right angular setting. The lower-most pair of input devices 82 may turn rotation of the brush 58 on and off. The wheel input device 84 may be a continuously variable speed of rotation control.

Finally, manipulating the entire handle body 70 may lift and lower the entire work tool 22B (FIG. 3) by causing the receiver 24 (FIG. 1) to lift and lower. It will be understood that other types of input devices may be substituted for those illustrated, provided they are suitable for the control task required by the work tool 22B.

Figure 6:
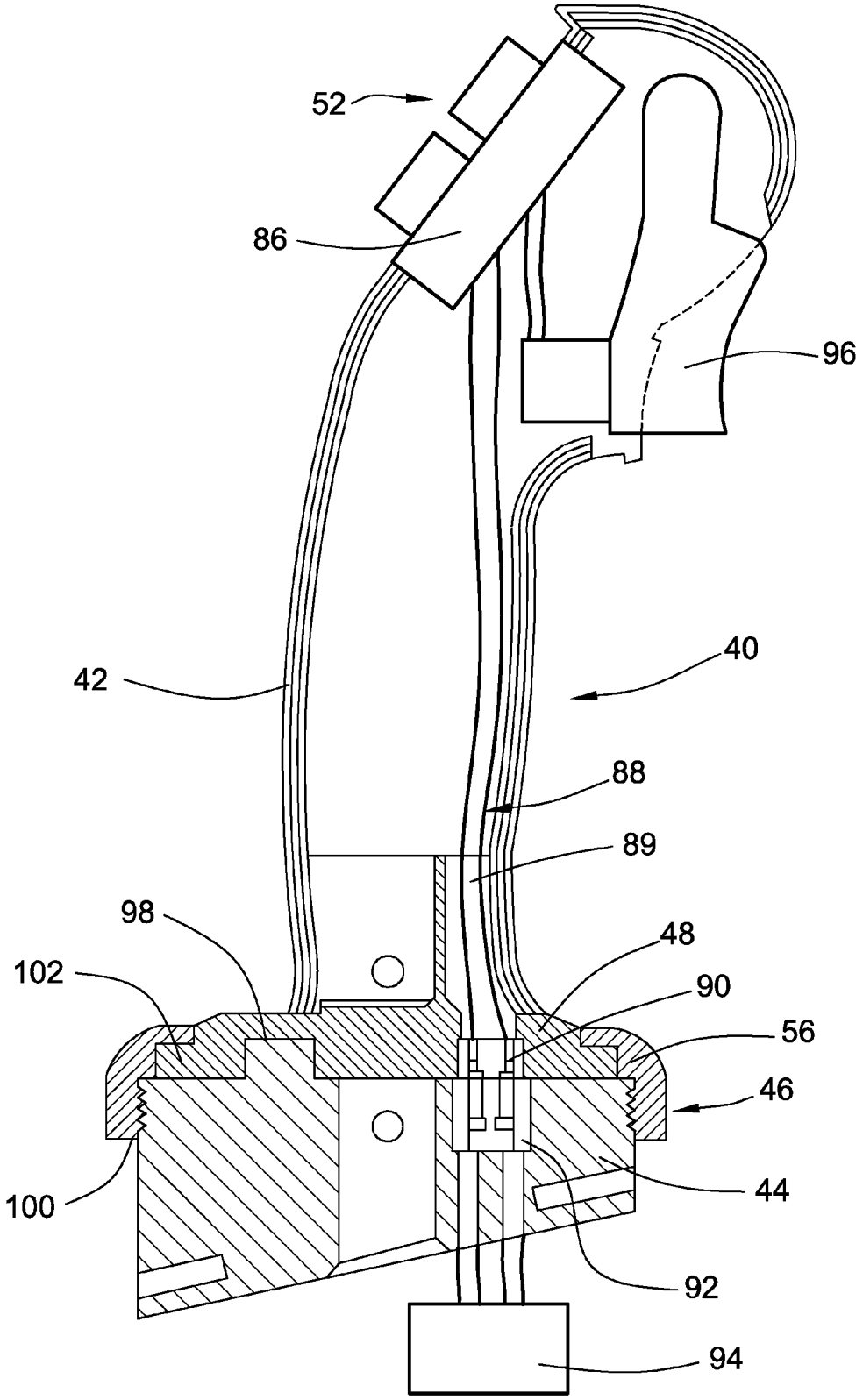
FIG. 6 is a cross section view of an embodiment of a quick connect joystick and base.

FIG. 6 shows one embodiment of a joystick 40 in cross section. The joystick 40 includes a handle body 42, inside which is disposed a first electronic controller 86, which is operably associated with the first plurality of input devices 52. The input devices 52 may include a trigger-style input device 96 in communication with the first electronic controller 86. The trigger-style input device 96 may be used by an operator to actuate the work tool 22A (FIG. 3). In one example, the trigger-style input device 96 could, in a depressed state, cause the tool to operate, and in a released state could cause the tool to stop operation.

The joystick 40 includes a first electronic communication system 88 disposed in the handle body 42 that includes electrical wiring 89 interconnecting the first electronic controller 86 to a first electrical connection 90. The wiring 89 is disposed in the handle body 42 and the first electrical connection 90 is disposed in the attachment end 54 of the joystick 40. The first electronic communication system 88 may also be wireless, and implemented by well-known systems and methods including a wireless transmitter.

The base 44 includes an electrical connection 92 that removably engages the first electrical connection 90. Communications from the joystick 40 to the base 44 arrive at a base electronic controller 94. The base electronic controller 94 may be integrated into the base 44 or the work machine adjacent the base. The base electronic controller 94 may convert signals from the first electronic controller 86 to control signals suitable for transmittal over a CAN-bus according to well-known systems and methods. The base electronic controller 94 may also supply power to the joystick 40.

Figure 7:
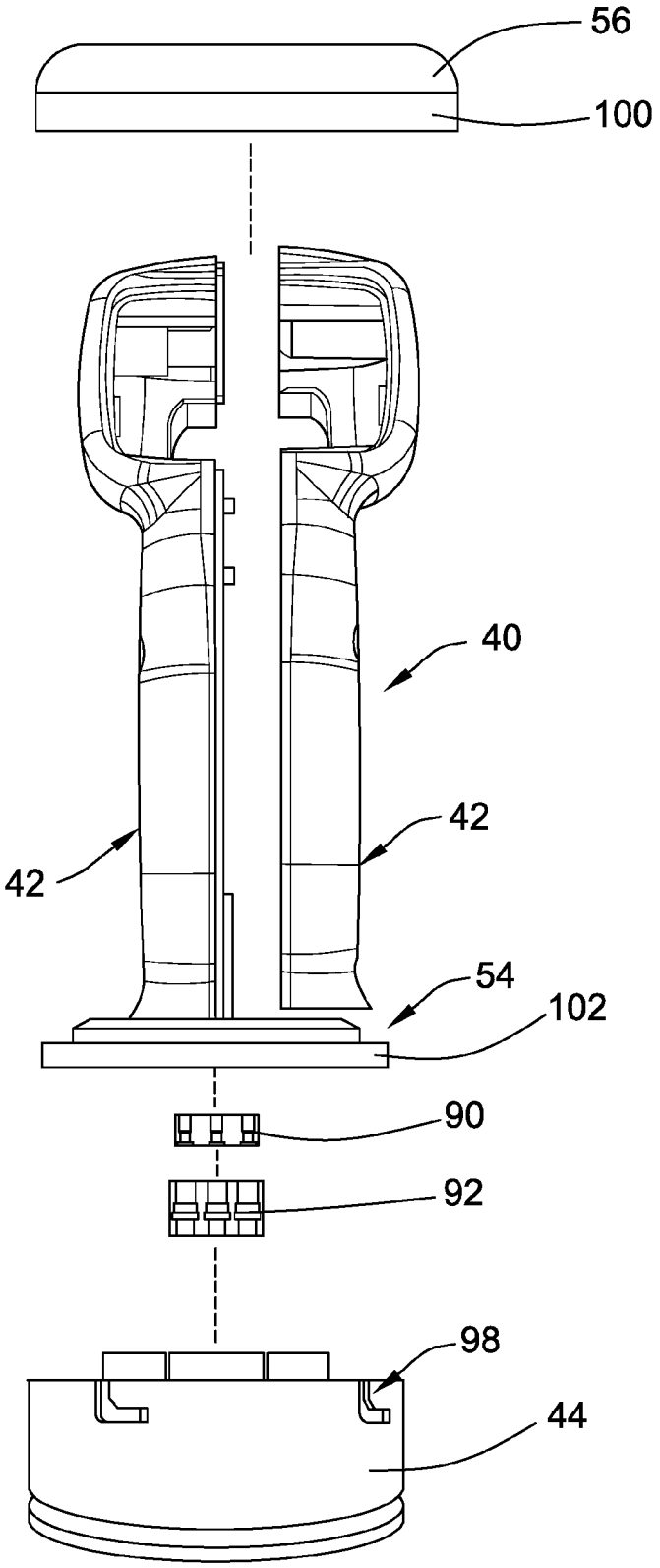
FIG. 7 is a representation of an embodiment of a quick connect joystick control signal communication system.

The base 44 and joystick 40 are connected mechanically. In one embodiment, the first mechanical connection 48 is formed on the first joystick 40 and connects to a mechanical connection 46 of the base 44. The second joystick 68 may have a second mechanical connection (not shown) that is the same as the first mechanical connection to also connect to the base 44. The connection between the joysticks 40, 68 and the base 44 may be a bayonet-style mount 98 or any suitable, releasable connection so that any suitably configured joystick can be mounted to the base. An assembled joystick 40, 68 and base 44 can be secured with a threaded nut 56 that threadably secures to the base 44 via threads 100. The attachment ends of joysticks 40, 68 may be provided with a flange 102 that is held captured by the nut 56. FIG. 7 shows the joystick 40 of FIG. 6 in an expanded state and without the electronic controllers, controls or wiring. In particular, the handle body 42 is a two-piece body for ease of manufacture and assembly.

Figure 8:
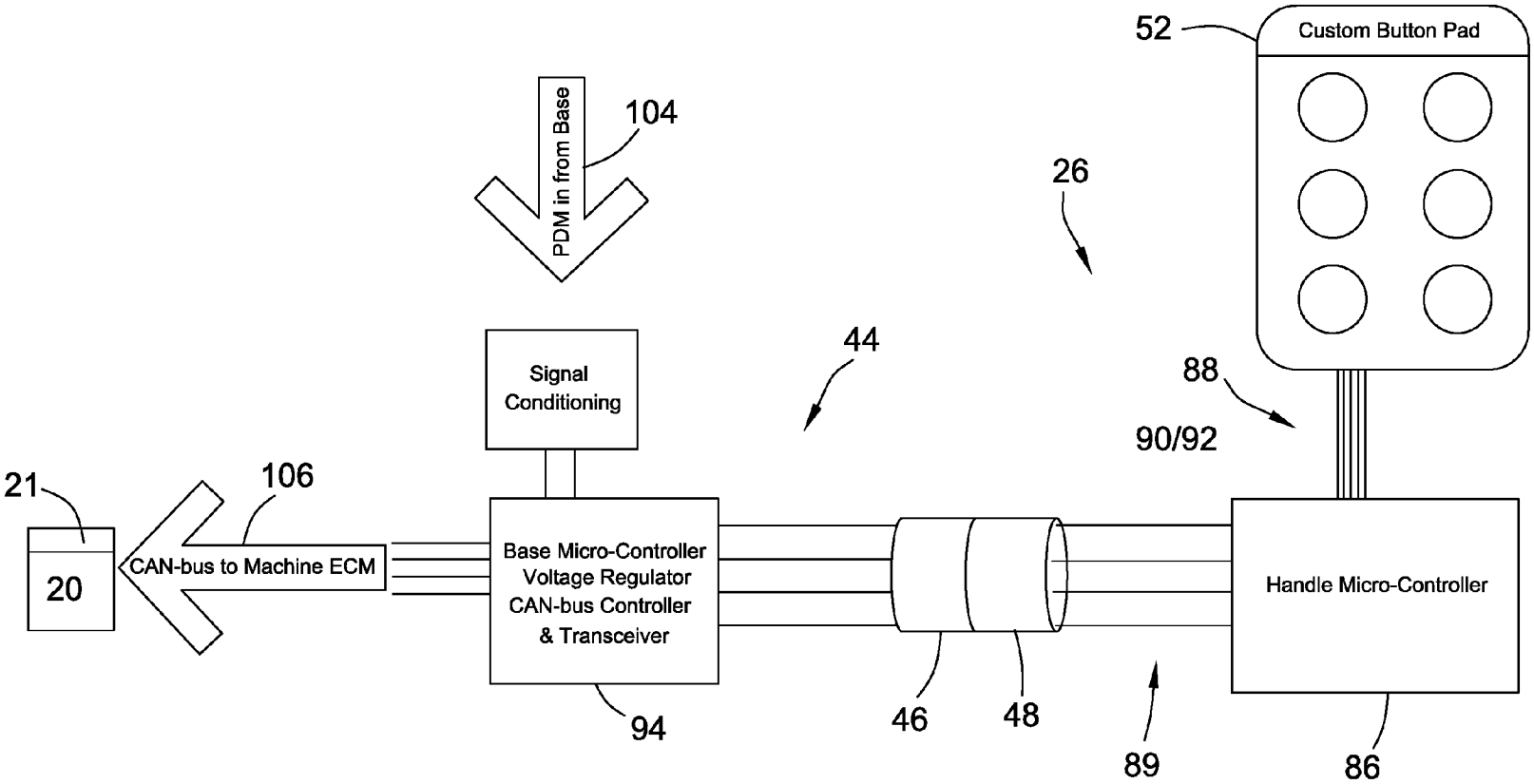
FIG. 8 is an exploded side view of a quick connect joystick, base, and the mechanical and electrical connections.

FIG. 8 describes one embodiment of control signal flow and communications between one of the joysticks 26, the base 44, and a work machine 20. Operation of a work tool 22 is initiated when one or more of the plurality of input devices 52 is manipulated by an operator. The input devices 52 are connected by wiring and/or circuitry 88 to the handle electronic controller 86. The electronic controller 86 records the discrete inputs from the input devices 52 and outputs a control signal message over a two-wire signal system 89 through the connectors 90/92 in the joystick 26 and base 44 respectively and to the base electronic controller 94. The base electronic controller 94 receives the control signal communications from the joystick electronic controller 86. In one embodiment, the base electronic controller 94 also receives PWM-inputs 104 from base x/y-axis position outputs according to a well-known method. The base electronic controller 94 configures all the received control signal communications and sends the control signal communications to the machine controller, such as an electronic control module (ECM) of work machine 20 via a well-known CAN-bus 106.

In operation, and referring to the above figures, the disclosure supplies a method of operating a work machine 20 including a machine controller 21. A first joystick 40 has a first plurality of control input devices 52 arranged in a first configuration. The first plurality of control input devices 52 are adapted to operate a first work tool 22A of the work machine. The first joystick 40 includes a handle body 42 and a first electronic controller 86 positioned in the handle body operably associated with the first plurality of control input devices 52. The first joystick 40 has a first electronic communication system 88 and a first mechanical connection 48 and a first electrical connection 90. A second joystick 68 has a second plurality of control input devices 76 arranged in a second configuration. The second plurality of control input devices 76 are adapted to operate a second work tool 22B of the work machine. The second joystick 68 includes a handle body 70, a second electronic controller 87 positioned in the handle body operably associated with the second plurality of control input devices 76, a second electronic communication system 85, a second mechanical connection 80 and a second electrical connection 91. A base 44 is associated with the work machine 20. The base 44 includes a mechanical connection 46 and a base electronic controller 94 in operative communication with the machine controller. The method includes engaging the mechanical connection 46 on the base 44 with the first mechanical connection 48 on the first joystick 40. An electrical connection 92 on the base 44 and a first electrical connection 90 are connected to permit electrical transmission of communications relative to control signals to be carried out between the first electronic controller 86 and the base electronic controller 94. The first work tool 22A is operated with the first joystick 40. When the first work tool 22A is replaced with a second work tool 22B, the first joystick 40 is replaced with a second joystick 68 by disengaging the first joystick from the base 44 and engaging the mechanical connection 46 on the base with the second mechanical connection 80 on the second joystick 68. The electrical connection 92 on the base 44 and the second electrical connection 91 are connected to permit electrical transmission of the communications relative to the control signals to be carried out between the second electronic controller 87 and the base electronic controller 94 and the second work tool 22B is operated with the second joystick 68.

INDUSTRIAL APPLICABILITY

The present disclosure is applicable to systems and methods of adapting a work machine to operate a plurality of replaceable work tools. Systems according to the disclosure employ replaceable joystick controllers, each having different configurations optimized to the operator and/or the particular operating parameters and/or requirements of the selected work tool. Each of the joysticks has a standardized mechanical and/or electrical connection for attachment to the work machine via a standardized base. The base receives control communications from the joysticks and is configured to adapt the control signals to a standardized signal format such that the work machine operates the work tool according to inputs from the selected joystick.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A system for controlling a work machine including a machine controller, the work machine comprising:

a first joystick having a first plurality of control input devices arranged in a first configuration, the first plurality of control input devices adapted to operate a first work tool of the work machine, the first joystick comprising a first handle body, a first electronic controller positioned in the first handle body and operably associated with the first plurality of control input devices, a first electronic communication system, and a first mechanical connection;

a second joystick having a second plurality of control input devices arranged in a second configuration, the second plurality of control input devices adapted to operate a second work tool of the work machine, the second joystick comprising a second handle body, a second electronic controller positioned in the second handle body and operably associated with the second plurality of control input devices, a second electronic communication system, and a second mechanical connection; and a base associated with the work machine, the base including a mechanical connection and associated with a base electronic controller, wherein the base electronic controller is configured, in a first arrangement paired with the first joystick, to communicate with the first electronic controller via the first electronic communication system and transmit to the machine controller communications relative to control signals from the first electronic controller operating the first work tool with the mechanical connection releasably engaged to the first mechanical connection and wherein the base electronic controller is configured, in a second arrangement paired with the second joystick, to communicate with the second electronic controller via the second electronic communication system and transmit to the machine controller communications relative to control signals from the second electronic controller operating the second work tool with the mechanical connection releasably engaged to the second mechanical connection.

2. The system of claim 1, wherein the first electronic communication system includes a first electrical connection and the base includes an electrical connection that removably engages the first electrical connection, wherein engagement of the first joystick and the base attaches the first mechanical connection to the mechanical connection and electrically connects the first electrical connection with the electrical connection to permit electrical transmission of the communications relative to the control signals to be carried out between the first electronic controller and the base electronic controller.

3. The system of claim 2, wherein the second electronic communication system includes a second electrical connection and the electrical connection removably engages the second electrical connection, wherein engagement of the second joystick and the base attaches the second mechanical connection to the mechanical connection and electrically connects the second electrical connection with the electrical connection to permit electrical transmission of the communications relative to the control signals to be carried out between the second electronic controller and the base electronic controller.

4. The system of claim 1, wherein the base includes a wireless transmitter in communication with the base electronic controller to transmit to the machine controller the communications relative to the control signals to be carried out.

5. The system of claim 1, wherein the first joystick and the second joystick are interchangeable relative to the base, wherein the first joystick is attached to the work machine when the first work tool is connected to the work machine, and wherein the second joystick is attached to the work machine when the second work tool is connected to the work machine.

6. The system of claim 1, wherein the first electronic controller is configured to record input signals from the first plurality of control input devices and the second electronic controller is configured to record input signals from the second plurality of control input devices.

7. The system of claim 6, wherein communication between the first and second electronic communication systems and the base electronic controller is conducted via serial communication.

8. The system of claim 7, wherein the base electronic controller is configured to transmit the input signals via a CAN-bus to the machine controller to operate the first work tool in the first arrangement and the second work tool in the second arrangement.

9. The system of claim 1, wherein the base electronic controller is configured to determine which of the first joystick and the second joystick are attached.

10. The system of claim 9, wherein each of the first electronic controller and the second electronic controller includes a respective unique identifier that the base electronic controller uses to determine which of the first joystick and the second joystick is attached.

11. The system of claim 1, wherein the mechanical connection permits tool-less attachment of either one of the first joystick and the second joystick.

12. The system of claim 11, wherein the mechanical connection includes a bayonet mount.

13. The system of claim 1, wherein the periphery of the base includes an outer threaded portion and the first joystick and the second joystick both includes a respective peripheral flange and the system further comprises a threaded collar sized and shaped to fit over the peripheral flange and threadably engage the outer threaded portion of the base to attach either one of the first joystick and the second joystick to the base.

14. A method of operating a work machine including a machine controller, a first joystick having a first plurality of control input devices arranged in a first configuration, the first plurality of control input devices adapted to operate a first work tool of the work machine, the first joystick comprising a first handle body, a first electronic controller positioned in the first handle body and operably associated with the first plurality of control input devices, a first electronic communication system, a first mechanical connection and a first electrical connection, a second joystick having a second plurality of control input devices arranged in a second configuration, the second plurality of control input devices adapted to operate a second work tool of the work machine, the second joystick comprising a second handle body, a second electronic controller positioned in the second handle body and operably associated with the second plurality of control input devices, a second electronic communication system, a second mechanical connection and a second electrical connection, and a base associated with the work machine, the base including a mechanical connection, an electrical connection, and a base electronic controller in operative communication with the machine controller, the method comprising:

engaging the mechanical connection on the base with the first mechanical connection on the first joystick;

connecting the electrical connection on the base and the first electrical connection to permit electrical transmission of communications relative to control signals to be carried out between the first electronic controller and the base electronic controller;

operating the first work tool with the first joystick;

replacing the first work tool with the second work tool;

replacing the first joystick with the second joystick by disengaging the first joystick from the base and engaging the mechanical connection on the base with the second mechanical connection on the second joystick;

connecting the electrical connection on the base and the second electrical connection to permit electrical transmission of the communications relative to the control signals to be carried out between the second electronic controller and the base electronic controller; and operating the second work tool with the second joystick.

15. The method of claim 14, comprising:

determining which of the first joystick and the second joystick are attached; and generating control signals corresponding to input signals received from operation of the attached one of the first joystick and the second joystick.

16. A work machine, comprising:

a first work tool and a second work tool which are mountable to the work machine, each of the first work tool and the second work tool having a set of operating parameters associated therewith;

at least one of a mechanical system, an electromechanical system, and a hydraulic system positioned on the work machine to operate a mounted one of the first work tool and the second work tool;

a machine controller configured to control the operation of the at least one of the mechanical system, the electromechanical system, and the hydraulic system;

a first joystick having a first plurality of control input devices arranged in a first configuration adapted to operate the first work tool, the first joystick comprising a first handle body, a first electronic controller positioned in the first handle body and operably associated with the first plurality of control input devices, a first electronic communication system, and a first mechanical connection;

a second joystick having a second plurality of control input devices arranged in a second configuration adapted to operate the second work tool, the second joystick comprising a second handle body, a second electronic controller positioned in the second handle body and operably associated with the second plurality of control input devices, a second electronic communication system, and a second mechanical connection; and a base associated with the work machine, the base including a mechanical connection and being associated with a base electronic controller, wherein the base electronic controller is configured, in a first arrangement paired with the first joystick, to communicate with the first electronic controller via the first electronic communication system and transmit to the machine controller communications relative to control signals from the first electronic controller operating the first work tool with the mechanical connection releasably engaged to the first mechanical connection and wherein the base electronic controller is configured, in a second arrangement paired with the second joystick, to communicate with the second electronic controller via the second electronic communication system and transmit to the machine controller communications relative to control signals from the second electronic controller operating the second work tool with the mechanical connection releasably engaged to the second mechanical connection.

17. The machine of claim 16, wherein the first electronic communication system includes a first electrical connection and the base includes an electrical connection that removably engages the first electrical connection, wherein engagement of the first joystick and the base attaches the first mechanical connection to the mechanical connection and electrically connects the first electrical connection with the electrical connection to permit electrical transmission of the communications relative to the control signals to be carried out between the first electronic controller and the base electronic controller.

18. The machine of claim 17, wherein the second electronic communication system includes a second electrical connection and the electrical connection removably engages the second electrical connection, wherein engagement of the second joystick and the base attaches the second mechanical connection to the mechanical connection and electrically connects the second electrical connection with the electrical connection to permit electrical transmission of the communications relative to the control signals to be carried out between the second electronic controller and the base electronic controller.

19. The machine of claim 16, wherein the base includes a wireless transmitter in communication with the base electronic controller to transmit to the machine controller the communications relative to the control signals to be carried out.

20. The machine of claim 16, wherein the first joystick and the second joystick are interchangeable relative to the base, wherein the first joystick is attached to the work machine when the first work tool is connected to the work machine, and wherein the second joystick is attached to the work machine when the second work tool is connected to the work machine.

* * * * *